United States Patent [19]

Coen

[11] 4,339,046

[45] Jul. 13, 1982

[54] NURSING BOTTLE

[76] Inventor: Robert Coen, 9 Briarcliff Dr., Port Washington, N.Y. 11050

[21] Appl. No.: 228,060

[22] Filed: Jan. 26, 1981

[51] Int. Cl.[3] ..... A61J 9/04

[52] U.S. Cl. ..... 215/11 B; 215/11 D; 215/11 E

[58] Field of Search ..... 215/11 R, 11 A, 11 B, 215/11 C, 11 D, 11 E

[56] References Cited

U.S. PATENT DOCUMENTS

| | | | |
|---|---|---|---|
| 951,419 | 3/1910 | Eberley | 215/11 R |
| 2,979,078 | 4/1961 | Witz | 215/11 D X |
| 3,931,886 | 1/1976 | Yamauchi | 215/11 R X |
| 4,010,861 | 3/1977 | Welten | 215/11 B |

FOREIGN PATENT DOCUMENTS

| | | | |
|---|---|---|---|
| 1067317 | 6/1954 | France | 215/11 C |
| 439585 | 12/1967 | Switzerland | 215/11 R |
| 20311 | of 1915 | United Kingdom | 215/11 B |

*Primary Examiner*—William Price
*Assistant Examiner*—Gary E. Elkins
*Attorney, Agent, or Firm*—Allison C. Collard; Thomas M. Galgano

[57] ABSTRACT

A nursing bottle unit includes an open-ended elongated tubular nursing holder having a neck portion at one open end thereof, a disposable and collapsible liquid-retaining bag open at one end thereof, received within the tubular nursing holder, a plug member at least partially received within the neck portion adapted to clamp a portion of the bag against the internal surface of the neck portion, and a nipple mounted on the neck portion. The plug member has an axial bore formed therethrough and a one-way check valve associated therewith for allowing liquid to be withdrawn from the bag while serving to prevent the entry of air thereinto. In addition, a piston or valve member is provided which, upon withdrawal of the liquid from the bag and as a result of the vacuum generated in the bag and the prevailing ambient atmospheric pressure, causes the bag to collapse so that the effective inner volume of the bag always substantially equals the volume of the liquid remaining therein.

8 Claims, 7 Drawing Figures

NURSING BOTTLE

The present invention relates to a nursing bottle. More particularly, it relates to a nursing bottle of the type including a tubular nursing holder, a disposable, collapsible, liquid-retaining bag received within the tubular nursing holder and a nipple.

Various types of nursing or baby bottles are well known in the art (see, for example U.S. Pat. Nos. 1,722,339; 3,075,666; 3,134,494; 3,204,855; 3,245,174; 3,871,542; and 4,076,139. While generally satisfactory in use, they each have certain drawbacks. For example, some allow the baby to swallow air when he is sucking on the nipple. Others do not afford sufficient thermal insulation so as to maintain the desired temperature of the liquid for a sufficient period of time. Furthermore, some do not permit the use of sanitary disposable plastic bags which obviates the necessity for boiling bottles. Moreover, certain bottles do not provide sufficient safeguards against accidental removal of the nipple by a nursing baby, while still allowing for easy removal by the patent, when desired. Furthermore, most are not universally adapted to receive different types of nipples such as the resilient nipples which snap over a holder (see U.S. Pat. No. 3,790,017) or ones which employ a rigid support for the nipple which must be screwed into place (e.g., U.S. Pat. No. 2,624,485).

It is therefore an object of the present invention to provide a novel nursing bottle wherein the possibility of the ingestion of air by the baby during nursing is substantially reduced.

It is a further object of the present invention to provide such a nursing bottle which maintains the desired temperature of the liquid for longer periods of time.

It is a further object of the invention to provide such a novel nursing bottle which is of relatively simple and economical construction, easy to use and safe and reliable in operation.

Certain of the foregoing and related objects are readily attained in a nursing unit which includes an open-ended elongated tubular nursing holder having a neck portion at one open end thereof and a disposable, collapsible liquid-retaining bag open at one end thereof which is received within the tubular nursing holder. The bag has an upper marginal portion adjacent to its open end which is folded outwardly and over the external surface of the neck portion. A plug member is at least partially received within the neck portion and is adapted to clamp a portion of the bag adjacent to the upper marginal portion thereof, against the neck portion. The plug member has an axial bore formed therethrough and a one-way check valve associated therewith for allowing liquid to be withdrawn from the bag while serving to prevent the entry of air into the bag. The nursing unit also includes a nipple mounted on the neck portion and a piston which is slidably retained in an air-tight manner within the holder beneath the bag. Upon withdrawal of the liquid from the bag and, as a result of the vacuum generated in the bag and the prevailing ambient atmospheric pressure, the piston is caused to move against the bag causing the bag to collapse, so that the effective inner volume of the bag always substantially equals the volume of the liquid remaining therein.

In an alternate embodiment of the invention, in place of the piston, the nursing unit includes valve means mounted within the holder beneath the bag for regulating the admission of air into the opposite end of the holder. The valve means permits the collapse of the bag during the withdrawal of liquid therefrom in a manner comparable to that effected by the piston, such that the effective inner volume of the bag always substantially equals the volume of the liquid remaining therein. Preferably, the valve means includes a thermal-insulating plug having at least one opening therein and at least one adjoining disc member having at least one opening therein, both of which are mounted on the holder adjacent the opposite open end of the nursing holder. The disc and the plug are moveable relative to one another so as to vary the degree of communication between the openings thereof.

In a particularly preferred embodiment of the invention, the nipple has a peripheral skirt portion which is received over the upper marginal portion of the bag folded over the external surface of the neck portion. Most desirably, the neck portion of the holder has internal screw threads and the plug member is externally threaded for threaded engagement with the internal threads of the neck portion. The plug member may also be provided with a peripheral flange which serves to press the upper marginal portion of the bag against the neck portion. In addition, the neck portion is preferably externally threaded as well and the unit advantageously includes an outer retaining cap for the nipple having an internally-threaded peripheral skirt portion for threaded receipt on the external threads of the neck portion with the peripheral skirt portion of the nipple and the upper portion of the bag disposed therebetween.

Most advantageously, the nursing holder has hollow sidewalls filled with a thermal-insulating material. The holder may desirably have a shoulder portion adjacent to the neck portion having a plurality of finger grip channels formed therein which merge with the neck portion, so as to facilitate removal of the nipple, when desired.

Other objects and features of the present invention will become apparent from the following detailed description when taken in connection with the accompanying drawings which disclose several embodiments of the invention. It is to be understood that the drawings are designed for the purpose of illustration only and are not intended as a definition of the limits of the invention.

In the drawings, wherein similar reference characters denote similar elements throughout the several views.

Figure 1:
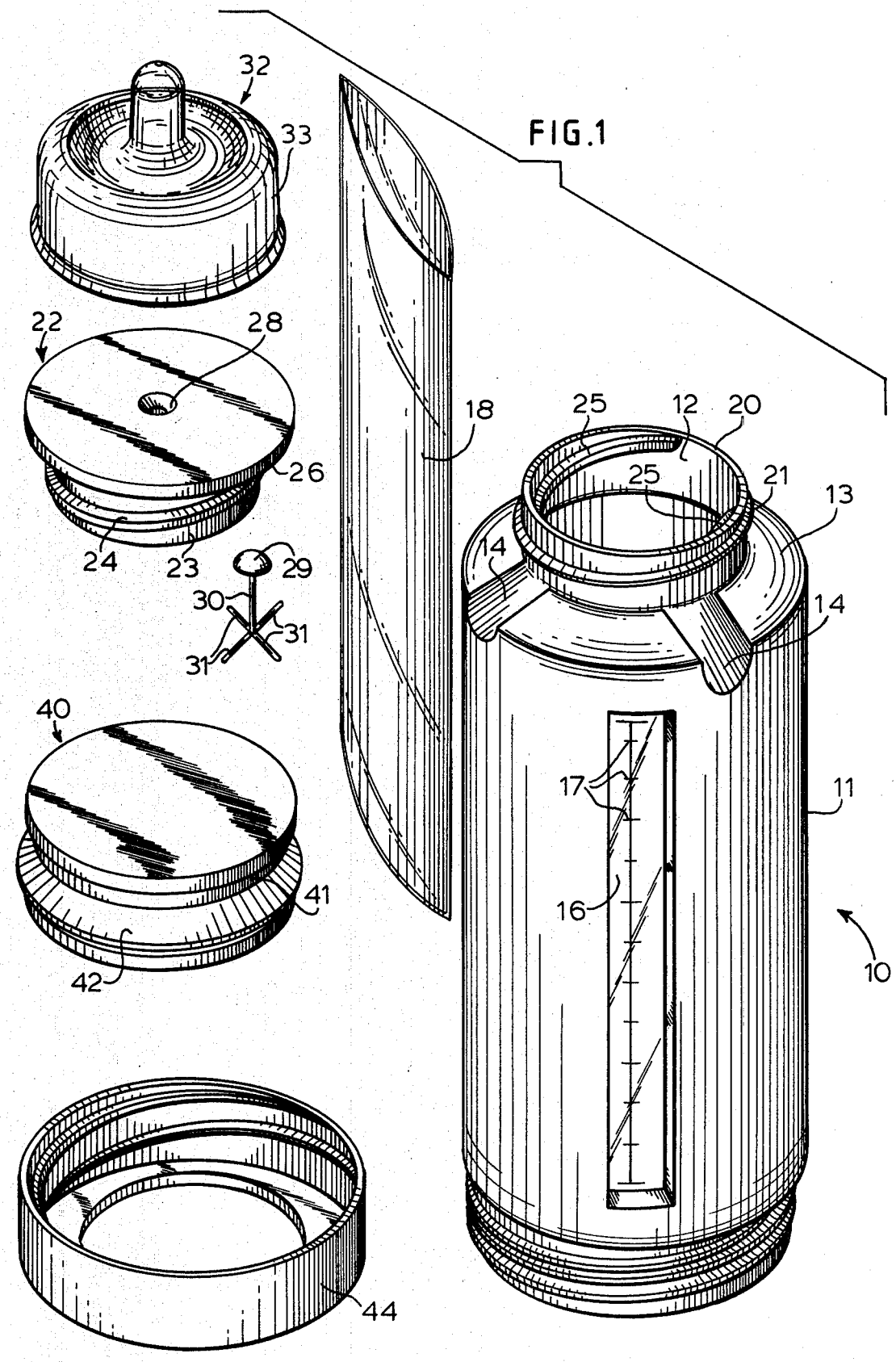
FIG. 1 is a perspective view of certain basic components of a nursing bottle embodying the present invention.

Referring now in detail to the drawings and, in particular to FIG. 1, therein illustrated in a nursing bottle or unit embodying the present invention, which comprises a plastic, substantially cylindrical, tubular holder or body portion 10 which is open at both ends. Holder 10 has a neck portion 12 at its upper end which merges with a conically-tapered shoulder portion 13 in which are formed radially-extending, spaced-apart finger grip channels 14.

Figure 2:
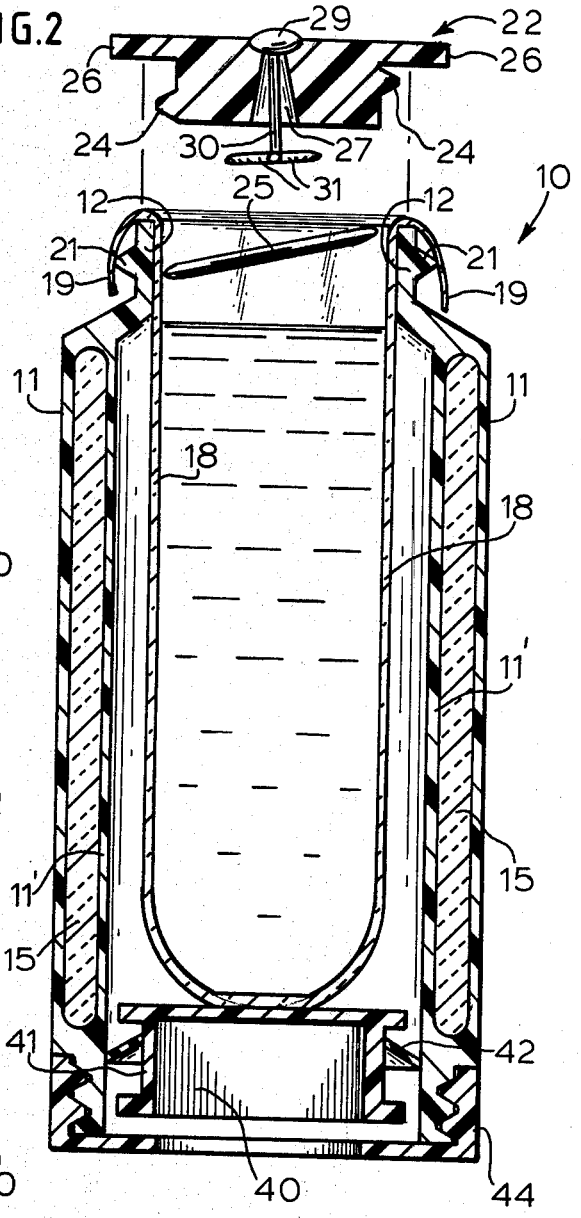
FIG. 2 is a cross-sectional view of the nursing bottle in a partially assembled state, when the outer protective retaining cap and nipple omitted and the inner thermal plug disposed above the nursing holder, prior to insertion.

As shown in FIG. 2, holder 10 is further provided with outer and inner spaced-apart sidewalls 11, 11' between which a sealed air gap is provided for thermal insulation; as illustrated, the same may be filled with a thermal insulation material 15, such as polyurethane or Styrofoam may be incorporated. In addition, holder 10 is provided with a longitudinally-extending window 16 provided with calibrated markings or other indicia 17 which may be used as a guide to indicate the amount of liquid, e.g., baby formula, milk, juice etc., added to or remaining in the holder.

Tubular holder 10 is of the general type adapted to hold a disposable, callapsible plastic bag or sac 18 having an open top end and a closed bottom end. Collapsible bag 18 is inserted into the top end of tubular holder 10 and an upper marginal edge 19 of bag 18 is turned outwardly and downwardly over the cylindrical rim 20 of neck portion 12 such that it extends over the external thread 21 thereof.

After a suitable liquid for the feeding of the baby has been placed in the collapsible bag 18 (the proper amount being determined with the aid of window 16 and scale 17), a thermal-insulating, plastic plug member 22 is inserted into the open end of neck portion 12. Plug member 22 has a depending, lower cylindrical portion 23 provided with an external thread 24 for threaded engagement with internal threads 25 of neck portion 12. In this way, plug member 22 serves to firmly wedge or clamp bag 18 against the interior of neck portion 12. Furthermore, plug member 22 is also provided with an upper flat, annular flange 26 intended to rest upon rim 20 of neck portion 12, thereby clamping bag 18 therebetween as well. As can be further appreciated, plug 22 cooperates with thermal insulation 13 to sustain the desired temperature of the liquid contained in bag 18.

Plug member 22 is further provided with a central upwardly-tapered throughbore 27, the upper end of which is provided with a generally hemispherically-shaped recessed seat 28 for receipt thereon of a generally spherical- or oval-shaped valve head 29 of a valve member which serves as a check valve. Valve head 29 is connected to a valve stem 30 which extends downwardly though bore 27 and is connected to a cross-shaped restraining member 31; the operation of the valve member will be discussed in greater detail hereinafter.

Figure 4:
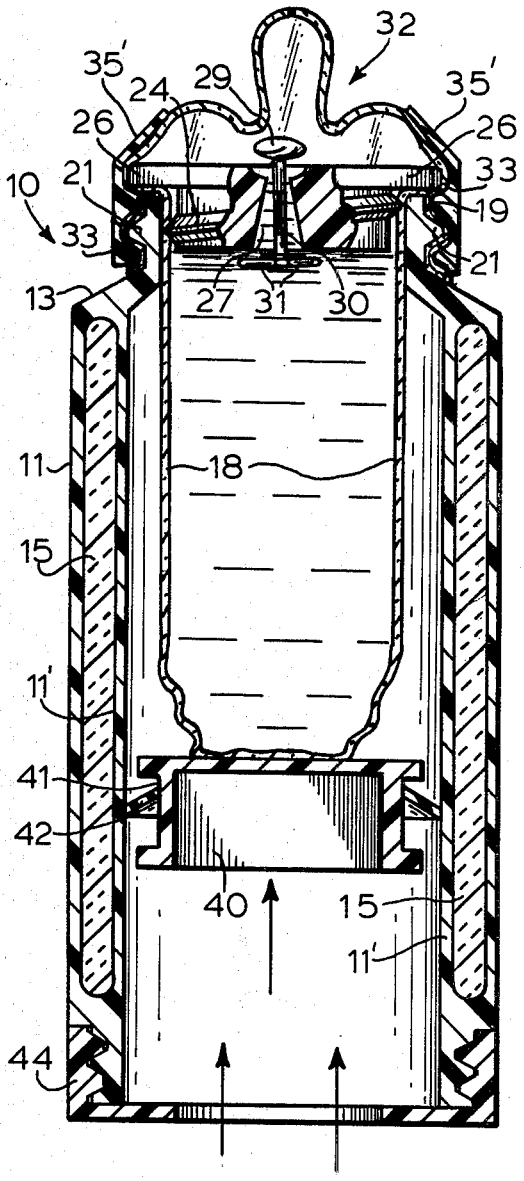
FIG. 4 is a cross-sectional view, in part elevation, of the nursing bottle in a fully assembled state, further showing upward movement of the piston during withdrawal of the liquid from the collapsible bag.

As seen best in FIG. 4, following insertion of plug member 22, a nipple 32, preferably made of rubber, is fitted by means of its resilient peripheral skirt portion 33 over the upper marginal end portion 19 of bag 18 and the outer external surface of neck portion 12. Due to its resiliency, skirt portion 33 will serve to clamp marginal portion 19 against external thread 21 and the external surface of neck portion 12. As can be appreciated, the combination of the resilient rubber nipple 32 and its depending skirt 33, in cooperation with the external threaded surface of neck portion 12 and the similar mating relationship of plug member 22 with respect to the top rim 20 and the internally-threaded surface of neck portion 12, serves to securely lock and seal collapsible bag 18 in place in an air-tight and leak-proof manner.

Figure 3:
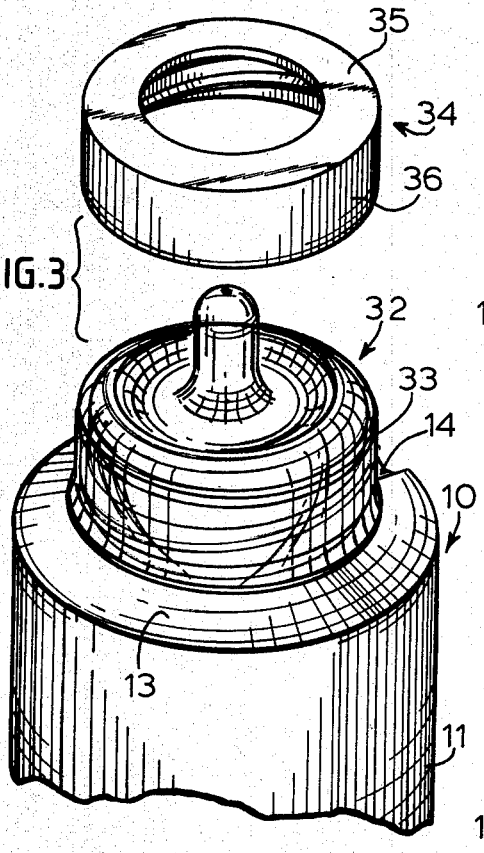
FIG. 3 is a fragmentarily-illustrated, enlarged perspective view of the top portion of the holder with the nipple mounted thereon and the protective retaining ring disposed thereabove, prior to mounting.

If, however, additional sealing protection is desired or necessary, a retaining ring or screw cap 34 of the type shown in FIG. 3 may be used. The same is provided with an upper annular, flat (FIG. 3) or frusto-conical (FIG. 4) nipple retaining flange 35, 35' from which depends a cylindrical, internally-threaded skirt portion 36 which, as shown in FIG. 4, may be threadably received on the external thread 21 of neck portion 12. If, in the other hand, the nipple is of the Gerber-type nipple which has a flat, annular-shaped base, a cap 34 with a cylindrical flange 35 (FIG. 3) would be used to retain the same on neck portion 12.

As shown in FIG. 2, positioned beneath the filled bag 18 is a generally cylindrical, hollow piston 40 which is retained within tubular holder 10 by means of a generally ring-shaped bottom screw cap 44 which is received on the bottom threaded end of tubular holder 10. Piston 40 is further provided with a circumferentially-extending U-shaped channel 41 on which is mounted an elastic sealing O-ring or gasket 42, preferably made of synthetic (e.g., neoprene) or natural rubber. O-ring 42 serves to effect a relatively air-tight seal between piston 14 and sidewall 11' of holder 10, while still allowing for vertical sliding movement of piston 41.

In operation, when nursing, the baby will suck on nipple 32 causing valve head 29 to be displaced upwardly and removed from seat 28, thereby allowing liquid to be withdrawn through throughbore 27 and, in turn, the bore of nipple 32; the X-shaped restraining member 31, of course, preventing complete withdrawal and disengagement of the valve member from plug member 22. If the baby should stop sucking, valve head 29 will come to rest, once again, on valve seat 28, thereby preventing air from entering into bag 18.

Furthermore, at the same time that the baby is sucking on nipple 32 and liquid is withdrawn, the vacuum created in bag 18 and the ambient atmospheric pressure will cause piston 41 to move vertically upward, thereby causing collapse of bag 18 such that its effective internal volume equals the volume of the liquid remaining therein. This, of course, will further minimize the possibility of air entering bag 18. When the baby is finished, protective cap 34 and nipple 32 are removed, as well as plug member 22, and bag 18 is removed and disposed of. As can be appreciated, channels 14 of shoulder portion 13 faciliate removal of nipple 32 by allowing the parent to insert his or her finger or thumb beneath the edge of skirt 33 to grasp the same and effect outward and upward displacement thereof and, in turn, upward removal of nipple 32 from neck portion 12.

Figure 5:
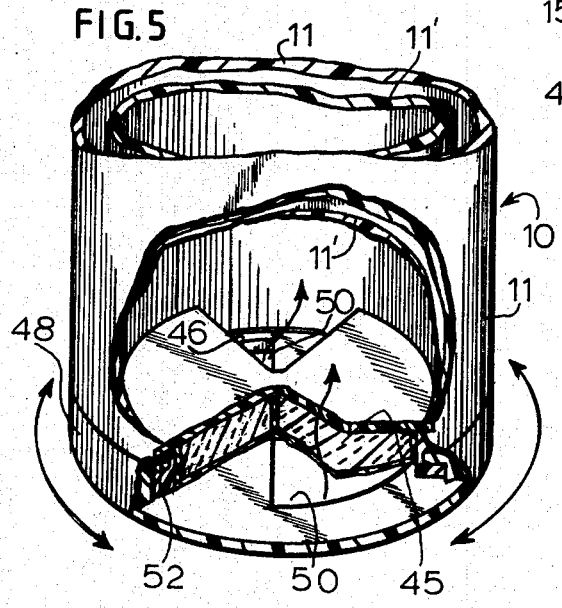
FIG. 5 is a fragmentarily-illustrated perspective view of an alternate embodiment of the invention which employs an air regulating valve means instead of the piston.
Figure 6:
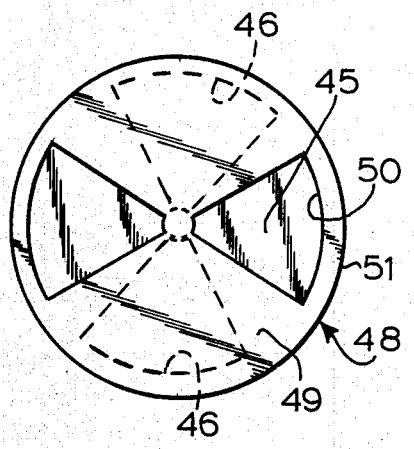
FIG. 6 is a bottom view of the air regulating valve means shown in FIG. 5, in a fully closed position.
Figure 7:
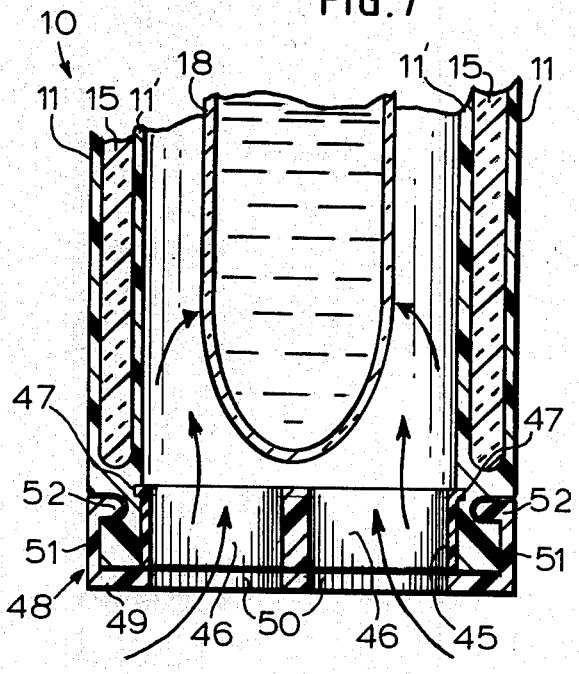
FIG. 7 is a fragmentarily-illustrated cross-sectional view showing the valve means in an open position.

As shown in the alternate embodiment of FIGS. 5, 6 and 7, instead of piston 41, an air regulating valve may be used in its place. In this embodiment, instead of piston 40 and bottom cap 44, a thermally-insulated disc-shaped, bottom plug 45 having two sector-shaped openings 46 formed therein, displaced 180° from one another, is fitted within the bottom open end of holder 10 in a friction-fit manner; this being effected with the aid of a resilient upper annular flange 47 extending radially-outwardly from the upper end of plug 45 and a corresponding configured radially-inwardly opening channel provided in wall 11' adjacent to its bottom end. Also provided is a rotatable bottom cap 48 having a circular base wall 49 with two sector-shaped openings 50 formed therein, also displaced 180° from one another, and an upstanding cylindrical sidewall 51. Sidewall 51 has a radially-inwardly directed resilient flange 52 at the upper end thereof configured for sliding snap-fit mating engagement with a corresponding circumferentially-extending, radially-outwardly opening channel provided in sidewall 11 of holder 10. This mounting method allows for rotation of cap 48 so that openings 50 thereof may be moved between an open (FIG. 7) and closed (FIG. 6) position with respect to the sector-shaped openings 46 of plug 45. By regulating the opening the opening and closing of this valve means, air may be allowed to enter the interior of holder 14 (see FIG. 7) and thereby effect collapse of bag 18 upon withdrawal of liquid therefrom, in the manner similar to that effected by piston 40.

Thus, while only several embodiments of the present invention have been shown and described, it will be obvious that many changes and modifications may be made thereunto, without departing from the spirit and scope to the invention.

What is claimed is:

1. A nursing unit comprising:

an open-ended, elongated, tubular nursing holder having a hollow sidewall and a neck portion at one open end thereof;

a disposable, collapsible, liquid-retaining bag open at one end thereof received within said tubular nursing holder, said bag having an upper marginal portion adjacent to said open end thereof folded outwardly and over the external surface of said neck portion;

a plug member at least partially received within said neck portion adapted to clamp a portion of said bag adjacent to said upper marginal portion thereof against the internal surface of said neck portion, said plug member having an axial bore formed therethrough and a one-way check valve associated therewith for allowing liquid to be withdrawn from said bag while serving to prevent the entry of air thereinto;

a nipple mounted on said neck portion; and a piston slidably retained in an air-tight manner within said holder beneath said bag which, upon withdrawal of the liquid from the bag and as a result of the vacuum generated in the bag and the prevailing ambient atmospheric pressure, is caused to move against said bag causing the collapse thereof so that the effective inner volume of the bag always substantially equals the volume of the liquid remaining therein.

2. A nursing unit comprising:

an open-ended, elongated, tubular nursing holder having a hollow sidewall and a neck portion at one end thereof;

a disposable, collapsible, liquid-retaining bag open at one end thereof received within said tubular nursing holder, said bag having an upper marginal portion adjacent to said open end thereof folded outwardly and over the external surface of said neck portion;

a plug member at least partially received within said neck portion adapted to clamp a portion of said bag adjacent to said upper marginal portion thereof against the internal surface of said neck portion, said plug member having an axial bore formed therethrough and a one-way check valve associated therewith for allowing liquid to be withdrawn from said bag while serving to prevent the entry of air thereinto;

a nipple mounted on said neck portion; and valve means mounted within said holder beneath said bag for regulating the admission of air into the opposite end of said holder so as to permit the collapse of the bag during the withdrawal of liquid therefrom in such a manner that the effective inner volume of said bag always substantially equals the volume of the liquid remaining therein.

3. The nursing unit according to claim 1 or 2, wherein said neck portion of said holder has an internal screw thread and wherein said plug member is externally threaded for threaded engagement with the internal thread of said neck portion.

4. The nursing unit according to claim 1 or 2, wherein said nipple has a peripheral skirt portion receivedover said upper marginal portion of said bag folded over the external surface of said neck portion.

5. The nursing unit according to claim 4, wherein said neck portion of said holder has an external screw thread, wherein said unit additionally including an outer retaining cap for said nipple having an internally threaded peripheral skirt portion for threaded receipt on said external thread of said neck portion with said periheral skirt portion of said nipple and said upper marginal portion of said bag disposed therebetween, and wherein said plug member has a peripheral flange which serves to press said upper marginal portion of said bag against said neck portion.

6. The nursing unit according to claim 1 or 2, wherein said holder sidewalls are filled with a thermal-insulating material.

7. The nursing unit according to claim 1 or 2, wherein said nursing holder has a shoulder portion adjacent to said neck portion having a plurality of finger grip channels formed therein which merge with said neck portion.

8. The nursing unit according to calim 2, wherein said valve means includes a thermal-insulating plug having at least one opening therein and at least one adjoining disc member having at least one opening therein, both of which are mounted on said holder adjacent the opposite open end thereof, said disc and plug being movable relative to one another so as to vary the degree of communication between the openings thereof between a completely open and closed position.

* * * * *